US005172535A

United States Patent [19]

Jongh et al.

[11] Patent Number: 5,172,535

[45] Date of Patent: Dec. 22, 1992

[54] FIBER REINFORCED PLASTIC GRID

[75] Inventors: Jacobus J. M. Jongh; Michael H. Collins, both of Arnhem, Netherlands

[73] Assignee: Shell Oil Company, Houston, Tex.

[21] Appl. No.: 535,693

[22] Filed: Jun. 11, 1990

[30] Foreign Application Priority Data

Sep. 18, 1989 [GB] United Kingdom ..... 8921076

[51] Int. Cl.[5] ..... D03D 3/00; E04H 12/00

[52] U.S. Cl. ..... 52/667; 139/384 R

[58] Field of Search ..... 52/662, 667, 108, DIG. 10, 52/311, 180, 181; 156/293, 148; 139/410, 384 R

[56] References Cited

U.S. PATENT DOCUMENTS

| | | | |
|---|---|---|---|
| 2,252,533 | 8/1941 | Tench | 189/82 |
| 2,356,675 | 8/1944 | Lachman | 189/82 |
| 2,834,267 | 5/1958 | Beebe | 94/30 |
| 3,048,198 | 8/1962 | Koppelman et al. | 139/410 |
| 3,090,406 | 5/1963 | Koppelman et al. | 139/410 |
| 3,156,168 | 11/1964 | Nagin et al. | 94/5 |
| 3,307,317 | 3/1967 | Lynn | 52/667 |
| 3,538,957 | 11/1970 | Rheaume | 139/410 |
| 3,675,957 | 7/1972 | Lickliter et al. | 287/189.36 A |
| 3,861,108 | 1/1975 | Hartman | 52/667 |
| 3,943,980 | 3/1976 | Rheaume | 139/410 |
| 4,018,188 | 4/1977 | Burdette | 119/28 |
| 4,037,383 | 7/1977 | Diebold et al. | 52/664 |
| 4,159,606 | 7/1979 | Kindberg | 52/692 |
| 4,244,768 | 1/1981 | Wiechowski et al. | 156/293 |
| 4,258,662 | 3/1981 | Schafer | 119/28 |
| 4,291,515 | 9/1981 | Harding | 52/694 |
| 4,372,093 | 2/1983 | Ericsson | 52/694 |
| 4,522,009 | 6/1985 | Fingerson | 52/667 |
| 4,730,431 | 3/1988 | Ericsson | 52/694 |
| 4,748,786 | 6/1988 | Hannah | 52/694 |
| 4,829,739 | 5/1989 | Coppa | 52/DIG. 10 |
| 5,007,220 | 4/1991 | Lalvani | 52/DIG. 10 |

FOREIGN PATENT DOCUMENTS

WO87/06181 10/1987 France .

*Primary Examiner*—David A. Scherbel
*Assistant Examiner*—Michele A. Van Patten

[57] ABSTRACT

A fiber reinforced plastic grid comprises at least one truss beam having a pair of parallel fiber reinforced plastic chord members and a series of fiber reinforced shear members thatg are arranged between the chord members, wherein at least at one node between a shear member and chord member the fibrous reinforcement of the shear member passes into the chord member so that this shear member and at least a section of a chord member can be made of a continuous string of fiber reinforced plastic material.

7 Claims, 1 Drawing Sheet

FIBER REINFORCED PLASTIC GRID

BACKGROUND OF THE INVENTION

1. Description of the Prior Art

This invention pertains to a fiber reinforced plastic grid.

Fiber reinforced plastic grids are gaining acceptance where their low weight and maintenance free performance are valued. Significant savings in weight and in lifetime costs are achievable through the use of such products, and operational experience has indicated satisfactory performance of well over ten years in offshore environments. In view thereof fiber reinforced plastic grids are now frequently used as walkway grids on ships, offshore platforms and other marine structures.

The design of present commercial plastic grids is intimately related to the characteristics of the manufacturing techniques used for their production, usually pultrusion or moulding. A typical design of a conventional plastic grid is disclosed in U.S. Pat. Nos. 4,244,768 and 4,522,009. These prior art references disclose a fiber reinforced plastic flooring grating including a plurality of parallel I-beam support members that are interconnected by a series of transversal interconnecting members which pass through central openings in the support members. In this known design, the bending loads are carried by prismatic sections, which for typical unsupported spans contain a large degree of structural redundancy with respect to their capacity to sustain shear loading.

SUMMARY OF THE INVENTION

It is an object of the present invention to provide a fiber reinforced plastic grid which has a minimum of structural redundancy and which can be manufactured by low cost mass production techniques.

The fiber reinforced plastic grid according to the invention comprises at least one truss beam which includes a pair of parallel fiber reinforced plastic chord members and a series of fiber reinforced plastic shear members that are arranged between the chord members, wherein at least at one node between a shear member and a chord member the fibrous reinforcement of the shear member passes into the chord member.

Preferably the shear members are arranged in a zigzag pattern between chord members and the fibrous reinforcement is made of a single fiber tow or bundle of fiber tows which passes throughout the length of the truss beam alternatingly through a section of a chord member, a shear member and a section of the other chord member.

It is furthermore preferred that the grid comprises a plurality of truss beams that are arranged in parallel vertical planes such that the upper chord members of a pair of adjacent beams lie in a horizontal plane and wherein the nodes between the shear members and the chord members lying in said plane are interconnected by a pattern of diagonal and transversal fiber reinforced plastic members.

The fiber reinforced plastic grid according to the invention can be produced in an automated production process without the need for labour intensive jointing of individual structural elements into trusses. A suitable production process for the grid comprises an automatic placement by a robotic arm of resin impregnated fibers, followed by a compaction process in a separate press where excess resin is removed and a high geometrical accuracy is obtained.

The invention will be described in more detail, by way of example, with reference to the accompanying drawings, in which:

DESCRIPTION OF THE PREFERRED EMBODIMENT

Figure 1:
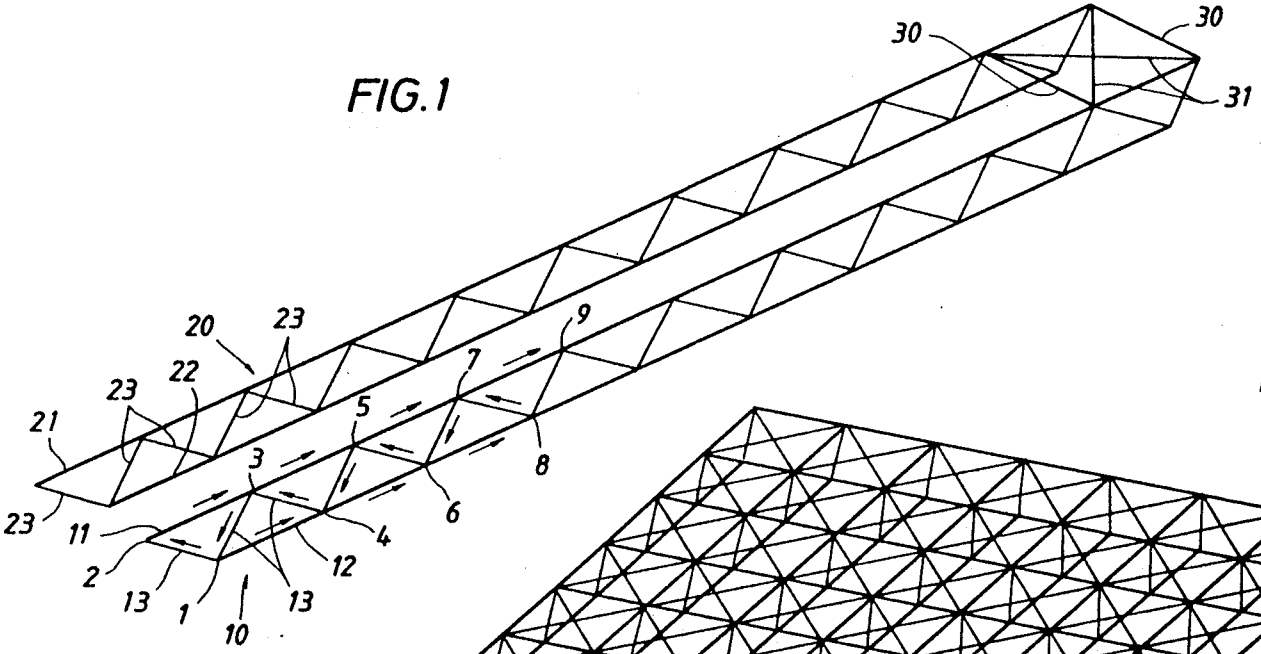
FIG. 1 shows a perspective view of two parallel truss beams of a fiber reinforced plastic grid according to the invention.

Referring to FIG. 1 there are shown two truss beams 10 and 20 that are located in two parallel vertical planes and that are interconnected by transversal members 30 and diagonal members 31 lying in a horizontal plane which passes through the upper chord members 11, 21 of the truss beams 10 and 20, respectively.

The upper chord members 11, 21 are together with the other components of the grid manufactured from fiber reinforced plastic such that the grid can be produced in an automated production process without the need for jointing individual elements into trusses.

To this end the upper chord member 11, 21, the lower chord member 12, 22 and the shear members 13, 23 of each truss beam 10, 20, respectively, are manufactured from a continuous fiber reinforced plastic material in the manner as described hereinbelow for the first truss beam 10.

Individual fibers are pulled from their creels and combined to a fiber bundle. This bundle is fed through a resin impregnation unit and a robotic arm. The arm places the resin impregnated bundle in a programmed pattern on a shuttle table.

A suitable process for fabricating the truss beam 10 of FIG. 1 is that the arm first places the bundle from the first node 1 towards the second node 2 to create the first shear member 13. Subsequently the arm is moved towards the third node 3 to create a section of the upper chord member 11 and then back to the first node 1 to create another shear member 13. Then the arm is moved to a fourth node 4 to create a section of the lower chord member 12, back to the third node 3 to create another shear member and to a fifth node 5 to create a section of the upper chord member 11. Then the arm is moved back to the fourth node 4 to create another shear member 13 and then to a sixth node 6 to create a section of the lower chord member 12. Subsequently the arm is moved back to the fifth node 5 to create another shear member 13 whereupon it is moved to a seventh node 7 to create a section of the upper chord member 11 and then back to the sixth node 6 to create another shear member 13. The next web is formed by moving the arm subsequently to nodes 8, 7 and 9 which process is repeated to create the remaining webs of the truss beam in a continuous manner.

The placed bundle may be located by an arrangement of pegs (not shown) on the shuttle table at the locations of the nodes 1, 2 etc. The pegs can be used to form built-in features of the final product.

If some sections of the truss beams are to made thicker than other sections the moving pattern of the robotic arm is selected such that the arm passes the "thicker" sections more times than the "thinner" sections. In general the chord members 11, 12 will be made thicker than the shear members 13. This may be accomplished by first creating part of the lower chord member 12 by moving the robotic arm up and down along the length of this member 12, subsequently creating by the above described fabrication process the shear members 13, the rest of the lower member 12 and part of the upper chord member 11, whereupon the arm is finally moved up and down along the length of the upper chord member 11 until this member 11 has its desired thickness. Also the shear members 13 may be formed in stages by inducing the arm to pass the shear members 13 several times during the fabrication process.

The truss beam 10 formed by the robotic arm is subsequently consolidated in a press where excess resin is removed and an accurate geometry of the truss beam 10 is obtained. The truss beam 10 together with the other fiber reinforced components of the grid can be made of any fiber reinforced plastic material. Suitable fiber materials are plain and textured glass, carbon, aramid whereas suitable plastic materials are polyester, epoxy, vinylester and MODAR ®.

After manufacturing the first truss beam 10, the second truss beam 20 and other beams are constructed in the same manner as described hereinbefore.

Once the individual truss beams have been produced they can be placed in parallel vertical planes on the shuttle table such that the upper chord members 11, 21 lie in a horizontal plane. The robotic arm is then used to transversally interconnect the upper chord members by a series of transversal members 30 and diagonal members 31. The members 30 and 31 may be fabricated in stages by inducing the robotic arm to move several times along the length of each member until it has obtained its desired thickness.

The transversal members 30 and diagonal members may be constructed from a continuous fiber reinforced plastic material by alternatingly forming the transversal members 30 and diagonal members 31.

The pegs that may be incorporated in the nodes of the upper truss beams 11, 21 could be used as anchoring points for the transversal and diagonal members 30, 31.

The selected overwinding pattern of crossed diagonal members 31 and parallel members 30, 15 between the nodes of the upper chord members 11, 21 of adjacent truss beams 10, 20, such that at each node at least one transversal member and one diagonal member is connected to a chord member, offering the possibility of spacing the truss beams 10, 20 widely, without increasing the grid opening, which is important if the grid is used as a walkway grid.

Figure 2:
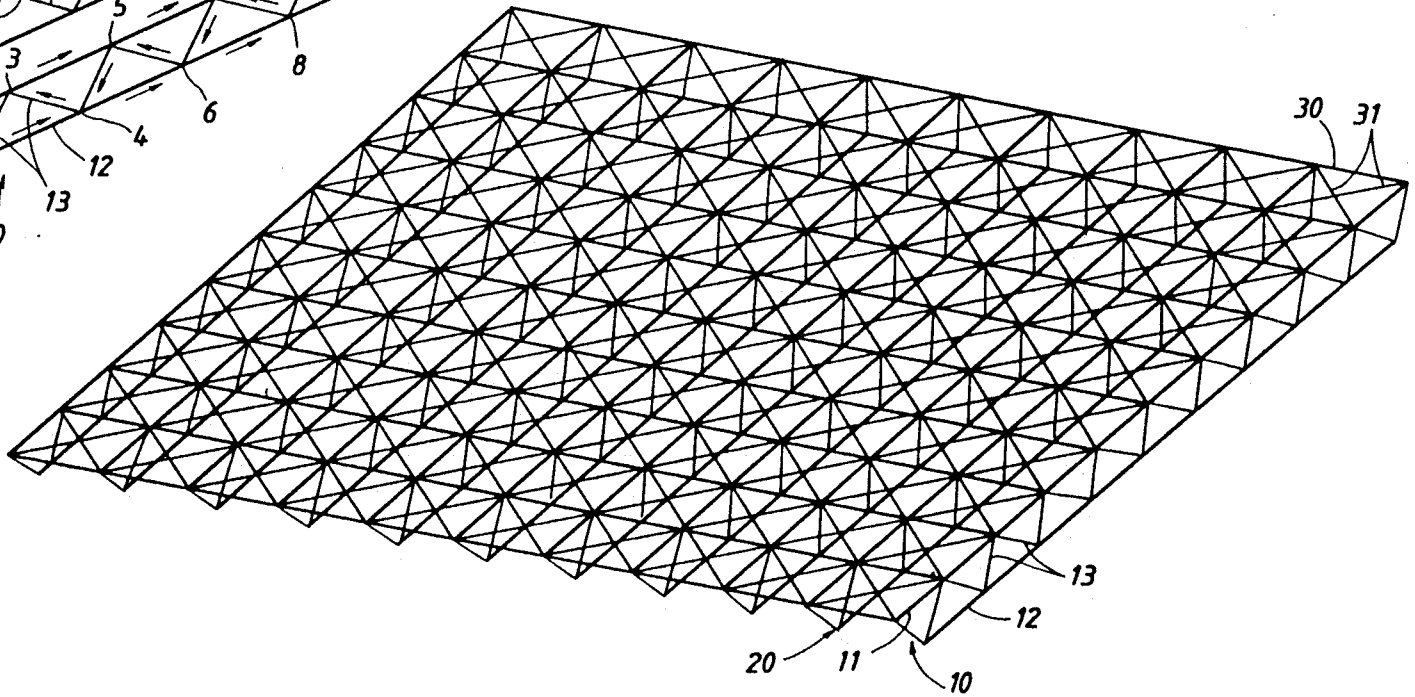
FIG. 2 shows a perspective view of a fiber reinforced plastic grid according to the invention in a deformed state.

FIG. 2 shows a completed grid according to the invention in a deformed state under a centrally applied vertical load. The construction of the grid offers the possibility of utilizing the superior mechanical properties of fiber reinforced plastics in the fiber direction of the material without requiring labour intensive jointing of the individual members into trusses.

It will be understood that the actual geometry of the grid and the winding process for producing it may be selected in accordance with the required strength and stiffness of the grid. Furthermore it is possible to interrupt at some locations the construction of various components of the truss beams 10, 20 and of the overwinding from a single continuous string or tow of a fiber reinforced plastic material. Accordingly it is only essential that at only at least one or a few nodes 1, 2, 3 etc. of one of the truss beams 10, 20 the fibrous reinforcement of a shear member 13 passes into a chord member 11 or 12 and vice versa so that at least at one node the labour intensive jointing of individual members is avoided and a firm connection is created between a shear member and a chord member.

Calculations have shown that glass-fiber reinforced epoxy truss beams plus the complete grid according to the invention have better stiffness and strength-to-weight ratios than those obtained for typical prismatic glass-fiber reinforced epoxy beams and steel beams.

The absence in the grid according to the invention of the requirement of jointing individual members into trusses at each node of the truss beam enables use of automated low cost mass production processes for manufacturing the grid.

It will be understood that the arrangement of all the transversal connections between adjacent truss beams at one side of the grid is attractive if the grid is used as a walkway grid. If the grid is to be used as a wall panel, however, it may be attractive to arrange the transversal connections between adjacent truss beams at both sides of the grid. Accordingly it is to be clearly understood that the embodiment of the invention shown in the drawings is illustrative only.

We claim as our invention:

1. A fiber reinforced plastic grid comprising at least one truss beam which includes a pair of parallel fiber reinforced plastic chord members and a series of fiber reinforced shear members that are arranged between the chord members, wherein within one node between a shear member and a chord member the fibrous reinforcement of the shear member passes into the chord member.

2. The grid of claim 1 wherein the shear members are arranged in a zig-zag pattern between the chord members and the fibrous reinforcement is made of a single fiber tow or bundle of fiber tows which passes throughout the length of the truss beam alternatingly through a section of a chord member, a shear member and a section of the other chord member.

3. The grid of claim 2 wherein the grid comprises a plurality of truss beams that are arranged in parallel vertical planes such that the upper chord members of a pair of adjacent beams lie in a horizontal plane and wherein the nodes between the shear members and the chord members lying in said plane are interconnected by a pattern of diagonal and transversal fiber reinforced plastic members.

4. The grid of claim 3 wherein at least at one node the fibrous reinforcement of a transversal member passes into a diagonal member.

5. The grid of claim 4 wherein the fibrous reinforcement of the transversal and diagonal members lying in said plane comprises a fiber tow or bundle of fiber tows which passes as a continuous string through substantially all the transversal and diagonal members in said plane horizontal.

6. The grid of claim 5 wherein at each node pegs are inserted in the chord members in said plane for anchoring of the diagonal and transversal members to the chord members.

7. The grid of claim 6 wherein at each node in said plane at least one diagonal member and at least one transversal member is connected to each chord member.

* * * * *